United States Patent [19]

Attia et al.

[11] Patent Number: 4,552,652

[45] Date of Patent: Nov. 12, 1985

[54] METHOD FOR REMOVING INORGANIC SULFIDES FROM NON-SULFIDE MINERALS

[75] Inventors: Yosry A. Attia, Columbus, Ohio; Douglas W. Fuerstenau, Berkeley, Calif.

[73] Assignee: The Regents of the University of California, Berkeley, Calif.

[21] Appl. No.: 542,349

[22] Filed: Oct. 17, 1983

[51] Int. Cl.[4] ..... B03B 1/00

[52] U.S. Cl. ..... 209/5

[58] Field of Search ..... 209/5, 4, 166, 167; 210/732, 727

[56] References Cited

U.S. PATENT DOCUMENTS

| | | | |
|---|---|---|---|
| 2,629,494 | 2/1953 | Brown | 209/166 |
| 3,692,673 | 9/1972 | Hoke | 210/734 |
| 4,078,993 | 3/1978 | Griffith | 209/167 |
| 4,211,642 | 7/1980 | Petrovich . | |

FOREIGN PATENT DOCUMENTS

| | | | |
|---|---|---|---|
| 144124 | 11/1960 | U.S.S.R. | 209/166 |
| 316473 | 12/1971 | U.S.S.R. | 209/166 |
| 883079 | 11/1981 | U.S.S.R. | 209/166 |

OTHER PUBLICATIONS

Attia, et al., "Devel. of Complexing Polymers for the Selective Flocculation of Copper Minerals".

Attia, et al., "Feasibility of Cleaning High Sulfur Coal Fines by Selective Flocculation", XIV Inter. Mineral Proc. Cng. (10/17/82).

Attia, et al., "Prin. of Separation of Ore Minerals by Selective Flocculation", *Recent Devel. in Sep. Science*, vol. IV (1978).

Attia, "Selective Flocculation: State of the Art Review", *Society of Mining Engineers of AIME*, Feb. 14–18, 1982.

*Primary Examiner*—Bernard Nozick

*Attorney, Agent, or Firm*—Majestic, Gallagher, Parsons & Siebert

[57] ABSTRACT

A method for removing inorganic sulfides from finely ground, non-sulfide minerals is provided. A polymeric agent having a molecular weight of from about 1,000 to about 300,000 and with a plurality of xanthate groups per molecule is admixed into an aqueous suspension including inorganic sulfides and non-sulfide minerals. The polymeric agent adsorbs onto the inorganic sulfides and maintains them as a dispersion while the remaining minerals are selectively separated, as by flocculation.

6 Claims, 1 Drawing Figure

FIGURE I
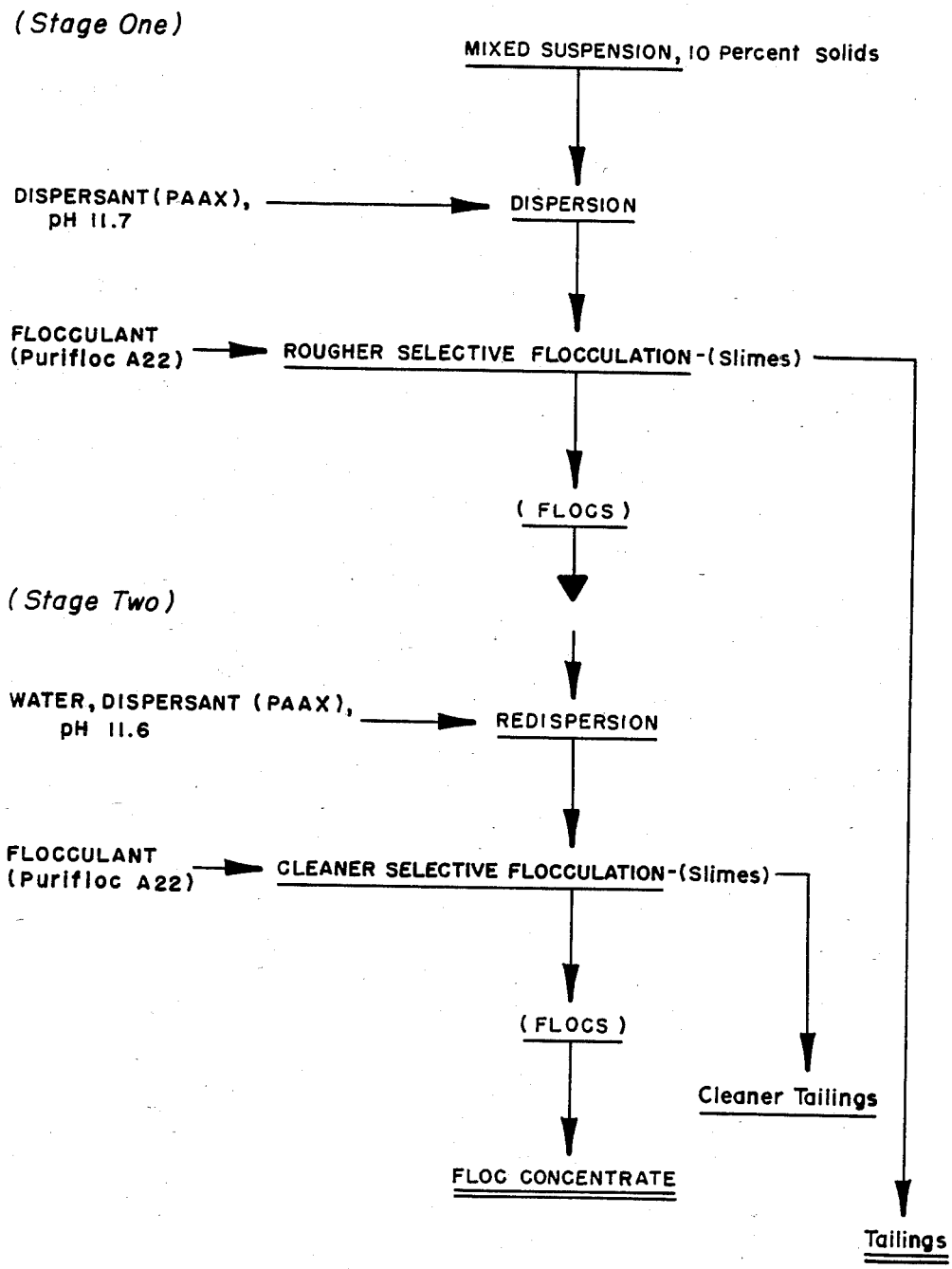

METHOD FOR REMOVING INORGANIC SULFIDES FROM NON-SULFIDE MINERALS

FIELD OF THE INVENTION

The present invention generally relates to removal of sulfides from non-sulfide minerals, and particularly to separating coal fines from associated shale and inorganic sulfur-containing minerals.

BACKGROUND OF THE INVENTION

Many coal deposits contain higher levels of sulfur than are environmentally acceptable, and significant amounts of coal are lost each year in the United States as coal fines and ultra fines because presently used techniques are not very effective in separating such coal from associated shale and sulfur-containing minerals.

According to a U.S. Bureau of Mines study in 1975, the demonstrated coal reserves of the United States are about 430 billion tons, of which only about 255 billion tons are recoverable with present technology. Currently, about 70% of the United States coal is produced from regions east of the Mississippi River; however, most of the eastern coals suffer from a high sulfur content, which on burning emits sulfur dioxide in excess of Environmental Protection Agency limits.

The presence of sulfur in coal is generally attributed to two forms: organic sulfur and pyritic sulfur. Although the proportion of pyritic sulfur to organic sulfur varies significantly from one coal seam to another, it appears that pyritic sulfur generally represents about 70% or more of the total sulfur. The pyritic sulfur is found in coal in a wide size distribution, but a significant proportion is in the very fine size fraction (less than about 25 microns).

For separation of coal from relatively coarse shale and pyrite, gravity-based techniques have been effectively utilized. For example, with sizes below about 300 microns to about 100 microns, froth flotation has been used satisfactorily for separating coal from shale, and even the separation of pyrite from coal has been achieved by flotation. But most of the processes become substantially less effective when the particle size of the coal in mixed ores is significantly below 100 microns.

U.S. Pat. No. 4,211,642, issued July 8, 1980, inventor Petrovich, discloses a froth flotation process for separating pyrite from coal by oil flotation. A relatively low molecular weight (less than 400) polyhydroxy, or aldose compound to which one xanthate group has been added is utilized in the Petrovich flotation process.

Various mixed ore minerals have been separated effectively by the selective flocculation process. For example, hematitic iron ore has been selectively flocculated with a suitable flocculating agent in conjunction with dispersants such as sodium silicate and polyphosphate. Further cleaning of the hemetite flocs is made by either cationic or anionic flotation of silica.

Selective flocculation has also been developed for the recovery of copper minerals from an oxidized copper ore, and such flocculation work has been disclosed by Attia and Kitchener, "Development of Complexing Polymers for the Selective Flocculation of Copper Minerals", which was presented at Proceedings of the 11th International Mineral Processing Congress, Cagliari, Italy, 1975. In this study, it was reported that conventional floth flotation was almost completely ineffective for concentrating the copper minerals from the ore, whereas the use of a very high molecular weight polymer (polyacrylamide modified to include dithiocarbamate groups) effected the selective flocculation separation of copper minerals from associated gangue minerals.

There have been a few attempts to separate coal from shale by selective flocculation. In one attempt, selective flocculation of coal from associated clays was achieved by using a partially hydrolyzed polyacrylamide flocculant and a dispersing agent called "Praestor-211K". Blasche and Sanak, "Separation of Silty Fractions from Coal Slimes by Selective Flocculation", *Zesz. Nauk. Alad. Gorn.-Hutn.*, Cracow, Gorn., 66 (1975) 19–30. In a similar attempt, selective flocculation of coal from shales was achieved by using a non-ionic polyacrylamide flocculant and a sodium hexamethaphosphate dispersant at alkaline pH. However, it has not been known how to remove successfully very fine pyrite particles from coal in a selective flocculation process.

SUMMARY OF THE INVENTION

It is an object of the present invention to disperse inorganic sulfides in a mixed ore suspension while selectively flocculating a non-sulfide mineral, such as finely ground coal.

Additional objects, advantages and novel features of the invention will be set forth in part in the description which follows, and in part will become apparent to those skilled in the art on examination.

In one aspect of the present invention, a method for removing inorganic sulfides from non-sulfide minerals comprises providing an aqueous suspension of a finely ground mixed ore. A polymeric agent is admixed into the aqueous suspension, which polymeric agent has a molecular weight of at least about 1,000 and which functions to adsorb onto inorganic sulfides. At least one non-sulfide mineral is then selectively separated from the aqueous suspension while the inorganic sulfide is maintained as a dispersion. The selective separation preferably includes flocculating the at least one non-sulfide mineral by means of a selective flocculating agent.

The polymeric agent which is admixed into the aqueous suspension before the selective separating, or flocculating, preferably has a molecular weight of from about 1,000 to about 300,000 and has a plurality of xanthate groups along a polymer chain. Such a polymeric agent adsorbs onto fine, inorganic sulfide particles of the mixed ore and functions as a selective depressant and dispersant during flocculation of non-sulfide minerals, such as coal fines, limestone, calcite, clays, or talc.

The present invention provides a method for solving the pyrite removal problem from fine and ultra fine coals, and holds potential for recovering ultra fine coals from process slimes and tailings ponds. Further, the present invention provides a means for removing inorganic sulfides, for example pyrite, molybdenite, covellite, chalcocite, chalcopyrite, galena and sphalerite, from non-sulfide minerals such as coal fines, talc, limestone, calcite, clays, and phosphate minerals.

BRIEF DESCRIPTION OF THE DRAWING

FIG. 1 diagrammatically illustrates the inventive method of separating coal from associated sulfur-containing minerals such as pyrite.

DETAILED DESCRIPTION OF PREFERRED EMBODIMENTS

The general separation of mixed solid particulates and finely disseminated ore minerals by selective flocculation is known, and a variety of selective flocculating agents have been described, for example, by Attia and Fuerstenau, *Recent Developments in Separation Science,* Vol. IV, pgs. 51–69 (1978), incorporated herein by reference. Separation by froth flotation utilizes similar surface chemistry principles as selective flocculation.

Broadly, the selective flocculation process is where suitable flocculating agents are selectively adsorbed onto desired mineral particles of a mixed suspension. The finely divided particles which are typically suspended in a liquid, usually water, to which the flocculating agent adsorbs then aggregate, or form flocs. The most effective flocculants typically are water-soluble compounds of high molecular weight (about 1 million or greater). Where recovery of one, or less than all, of the mineral components of a mixed suspension is desired, then a suitable selective flocculating agent is one which adsorbs only on the particular type of mineral particle or particles desired for recovery.

The inventive method includes a separating step for at least one non-sulfide mineral from a mixed ore. The separating is preferably by flocculation as a result of the addition of a suitable flocculating agent.

There are a variety of suitable selective flocculating agents known and useful in practicing the method of the present invention. For example, partially hydrolyzed polyacrylamide and polystyrene sulfonate flocculating agents are suitable. A particularly preferred flocculating agent is a polystyrene sulfonate sold by the Dow Chemical Company as "Purifloc-A22".

In practice of the inventive method, before selectively separating the one or more non-sulfide mineral particles, as by flocculation or froth flotation, a polymeric agent is first admixed into an aqueous suspension. This polymeric agent has a molecular weight of at least about 1,000, and performs a dual function. The polymeric agent adsorbs onto particles of inorganic sulfide and then maintains the inorganic sulfide particles as a dispersion during the subsequent separating step. That is, unlike the flocculating agent's function, the polymeric agent of the present invention depresses, or prevents, flocculation of the inorganic sulfide particles.

Suitable polymeric agents of the present invention preferably have a molecular weight of between about 1,000 to about 300,000, and more preferably from about 2,000 to about 20,000. These polymeric agents have a plurality of xanthate groups along the polymeric chain, and preferably include a plurality of hydrophilic groups (such as carboxyl), which groups are believed to strongly adsorb on the sulfide particles and prevent the subsequently added flocculating agent from adsorbing on such particles. The polymeric agents are substantially water soluble.

Xanthates (i.e. dithiocarbamates) are known as selective reagents for the flotation of heavy-metal sulfide minerals, and polymers with zanthate groups have been found useful as selective flocculants for certain heavy-metal minerals. It is thus surprising that suitable polymeric agents for practice of the present invention preferentially disperse inorganic sulfide particles and to depress their flocculation.

Polymeric agents in accordance with the present invention may be reaction products of carbon disulfide and linear or branched chain polymers (although cross-linked polymers, so long as sufficiently water soluble, are suitable) such as cellulose, methyl cellulose, sodium carboxy methyl cellulose, hydroxypropyl methyl cellulose, polyvinyl alcohol, polysaccharide, polyacrylic acid, methacrylic acid and its salts, and partially hydrolyzed acrylamide. Broadly, about 10% to about 75% of the functional groups of the polymeric starting material will be converted to xanthate groups to form a suitable polymeric agent. For example, the preferred polyacrylic acid, when modified to include a plurality of xanthate groups, will typically have about 3 to about 28 xanthate groups per molecule (when at a molecular weight of about 2,000). A second polymeric agent having a molecular weight of at least 1,000,000 may be used in an additional flocculation step.

The aqueous suspension of finely ground mixed ore, including at least one non-sulfide mineral from which an inorganic sulfide is desirably removed, has admixed therein a sufficient amount of the polymeric agent. As may be understood, the sufficient amount of polymeric agent will vary depending upon the weight percent of solids in suspension and the quantity or inorganic sulfide particles present. For example, the weight percent of polyxanthate, or polymeric agent, admixed with respect to the total solids weight in the suspension is preferably from about 0.02 to about 1.0, more preferably from about 0.1 to about 0.4. The pH of the suspension is preferably maintained between about 7 to about 11. The following experimental methods, materials and results are described for purposes of illustrating the present invention. However, other aspects, advantages and modifications within the scope of the invention will be apparent to those skilled in the art to which the invention pertains.

Example I, below, illustrates preparation of the polymeric agent in accordance with the present invention.

EXAMPLE I

Preparation of a Polyxanthate Dispersant (PAAX)

To a 50 ml, 1% solution of polyacrylic acid (mol. wt.=2000, obtained from Scientific Polymer Products, Inc.), 5.4 grams sodium hydroxide pellets were added and dissolved. 15 ml carbon disulfide ($CS_2$) was then added and the solution was shaken in a water bath at 35° C. to 55° C. for 2.5 hours. The crude reaction product ("PAAX") was carrot-red color.

Purification of the crude reaction product of PAAX was done by mixing 50 ml of the carrot-red solution, with excess amounts of methanol (up to 300 ml) to produce pale yellow precipitate. After standing for a period of time, the suspension was filtered off to recover the precipitate. The purified polyxanthate compounds (PAAX) as a precipitate was readily dissolved in distilled water. Care was exercised to minimize decomposition of the polyxanthate during the purification process.

Characterization of Purified PAAX Solutions was made by using the UV-Visible Spectroscopy technique. Model Carey-17 Spectrometer was used for these determinations. The UV-Spectra for these solutions showed distinct absorpotion peaks around 305 nm, which is the main absorption peak for the xanthate groups. This proved the presence of xanthate groups on the polyacrylic acid polymer.

The data of Table I(A) and I(B) below, illustrate selective flocculation experiments with individual mineral suspensions where one suspension was of finely ground coal and another was of finely ground pyrite.

TABLE I

| | Wt. % Settled, Coal | Wt. % Settled, Pyrite |
|---|---|---|
| Concentration of Polyacrylic Acid (Unmodified, M.W. = 2,000) | | |
| 100 mg/l | 62 | 58 |
| 200 mg/l | 50 | 54 |
| 300 mg/l | 56 | 55 |
| 400 mg/l | 55 | — |
| 500 mg/l | — | 56 |
| Concentration of Polyxanthate (Modified to Include Xanthate Groups, M.W. about 2,000) | | |
| 100 mg/l | 98 | 52 |
| 200 mg/l | 100 | 54 |
| 300 mg/l | 100 | 53 |
| 400 mg/l | 100 | 52 |

These experiments with individual mineral suspensions demonstrated the coal was totally flocculated, even at high concentrations of dispersant. That is, the polymeric agent, or polyxanthate dispersant, simply did not adsorb on the coal particles. Thus, the polymeric agent of the present invention is a selective dispersant for the pyrite particles.

The experiments further show that the selective dispersion effect of the polyxanthate was truly due to the modified polymer itself, and not to possible associated polysulfides in crude reaction product. By using 300 mg/1 of the purified PAAX solution, for example, about 96% of the coal suspension flocculated in five minutes, while the pyrite suspension remained stable. These tests confirmed that the selective dispersion action was due to the polyxanthate polymer itself.

Example II, below, illustrates the treatment of a mixed suspension containing 10% solids, which were composed of approximately 60% shale, 20% coal and 20% pyrite, all minus 37 microns in particle size, in accordance with the present invention utilizing a two-stage selective flocculation. The first stage (which utilized dispersion and then selective flocculation) was a rougher flocculation step, where rejection of most of the unwanted slimes (shale and pyrite) was to be made. The second stage involved cleaning the flocculated concentrate (coal) to reject more of the slimes and to obtain a higher quality product.

EXAMPLE II 3 grams of shale, 1 gram of coal and 1 gram pyrite were mixed in 50 ml distilled water, containing 200 mg/1 purified PAAX (Polyxanthate) dispersant, prepared as described in Example I, above. The suspension pH was 11.7. The suspension was magnetically stirred for 5 minutes at high shear rate, before administering 4 mg/1 of selective flocculating agent (Purifloc-A22). High shear stirring was continued for 60 seconds, followed by low shear stirring for 60 seconds. The suspension was transferred into a 100 ml cylinder, where manual rotation of the cylinder at an inclined position was performed for 5 minutes, after which the suspension was allowed to stand still for 3 minutes. The suspended fraction was decanted off and considered to be the final tailings (waste).

In the second stage (cleaning step), the flocs obtained in the first stage, were re-dispersed in 50 ml distilled water containing 100 mg/1 PAAX (polyxanthate) dispersant at pH 11.6. The suspension was stirred at high shear for 3 minutes after which 2 mg/1 Purifloc-A22 was added. Selective flocculation was containued, as described in the first stage. All three fractions were oven dried, weighted and analyzed for carbon content by a Leco analyzer using an induction furnace.

FIG. 1 outlines the procedural steps followed in Example II, including: (1) treatment of an initial suspension of coal, shale and pyrite with a polyxanthate dispersant; (2) flocculation of the coal with a floculating agent; (3) separation into coal flocs and tailings; and (4) repetition of steps 1, 2 and 3 to yield separated and flocculated coal "concentrate."

However, practice of the present invention may be with a single selective flocculation stage following the introduction and mixing of the polymeric agent, or dispersant, rather than re-dispersal of the first-stage flocs and second stage cleaning, since about 84% of the coal was recovered in the first flocculation fraction. Analysis of metallurgical balance and visual inspection indicated that the cleaning stage did not remove all entrapped slimes in the coal flocs, but that a major portion of the inorganic sulfides were removed from the coal recovered in the first flocculation fraction.

Example III, below, illustrates practice of the present invention without a second stage, cleaning step.

EXAMPLE III 50 ml mineral suspensions containing 2% solids (with equal proportions of coal and pyrite) were treated with different amounts of the PAAX dispersant (50 to 400 mg/1) while stirring continued for 5 minutes at high shear rate. The initial suspension pH before the addition of dispersant was about 10. The final suspension pH after the addition of the crude solution of PAAX was sometimes higher due to its high sodium hydroxide content and ranged between pH 10.7 to 11.5. At the end of dispersant conditioning time (5 minutes), 4 mg/1 Purifloc-A22 was administered into the suspension, and stirring was continued for 10 seconds at high shear, then lowered to a gentle agitation for an additional 10 seconds. The suspension was transferred into a 100 ml graduated cylinder and was allowed to stand still for 5 minutes. At the end of the settling period, the suspended solids were decanted off and the settled solids were recovered. Each fraction was placed in an evaporating dish, oven dried and weighted. Visual examination confirmed that the dispersed fraction was mainly pyrite, whereas the settled solids were mainly coal.

Pyrite has a specific gravity of about 5.4, while that of coal is around 1.6 to 1.8. In order to examine the effect of pyrite particle size on the dispersion by means of the polymeric agent, a pyrite suspension having only particle size below 10 microns was prepared and tested. Suspensions of coal and pyrite of particle size below 37 microns were also treated simultaneously. All suspensions were then treated in accordance with the present invention by admixing a polymeric agent into each suspension (PAAX) and then selectively separating by means of flocculation with a flocculating agent (Purifloc-A22). Each of the suspensions was also subjected to ultrasonic vibration (in a bath) for one minute before adding the flocculating agent.

It was found from these experiments that the pyrite suspension of less than about 10 microns particle size was much more stable than the suspensions of coal and pyrite of less than about 37 microns size. It is believed this is due to the settling of larger particles. The results also demonstrated that the ultrasonic treatment reduced the amount of flocculated coal slightly, but had no effect on the pyrite suspension of less than about 37 micron particle size. These results indicate that the selective dispersion of pyrite is more effective at smaller particle sizes, preferably less than about 100 microns, more preferably less than about 40 microns, and still more preferably less than about 10 microns.

In other studies, it was found that shale adsorbed the Purifloc-A22 flocculating agent, although not completely, but nevertheless in significant amounts below pH 7. This led to significant amounts of shale being present in the flocs from the separating steps at acidic pH. However, as the pH was increased, the adsorption of Purifloc-A22 on shale decreased, and at pH above about pH 9, no further adsorption of Purifloc-A22 on shale was noticed.

The effect of prolonged stirring on achieving selective flocculation by minimizing entrapment was also investigated. When the finely ground, mixed ore suspension was treated with a suitable flocculating agent at pH 10, then followed prolonged stirring at low shear for five minutes, selective flocculation of coal from shale was observed. Thus, it appears desirable that a more complete separation of coal from shale is achieved by adequate mechanical agitation.

In sum, the present inventive method provides selective dispersion of inorganic sulfide, such as pyrite, from finely ground, mixed ore by use of the suitable polymeric agent as previously described. Such a polymeric agent selectively adsorbs on the fine inorganic sulfide particles (such as pyrite) and maintains the sulfides in dispersion during the subsequent separation of at least one non-sulfide mineral from suspension (such as finely ground coal).

While the invention has been described in connection with specific embodiments thereof, it will be understood that it is capable of further modification, and that this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

We claim:

1. The method as in claim 2 wherein the polymeric agent of the admixing has a molecular weight of from about 2,000 to about 20,000 and is a reaction product of carbon disulfide and a polymer selected from the group consisting of cellulose, methyl cellulose, sodium carboxymethyl cellulose, hydroxypropyl methyl cellulose, polyvinyl alcohol, polysaccharide, polyacrylic acid, methacrylic acid and salts thereof, and partially hydrolyzed acrylamide.

2. A method for removing pyrite from finely ground coal comprising:

providing an aqueous suspension consisting essentially of an aqueous solution and solids, said solids including finely ground coal and pyrite suspended in said aqueous solution, said aqueous solution having a pH from about 7 to about 11;

admixing a first water soluble polymeric agent into said aqueous suspension to adsorb selectively onto said pyrite of said solids, said first polymeric agent having a molecular weight of from about 1,000 to about 300,000 and a plurality of xanthate groups;

aggregating said coal while maintaining at least a major portion of said pyrite having first polymeric agent adsorbed thereon as a dispersion in said aqueous suspension; and separating aggregated coal from said aqueous suspension.

3. The method as in claim 2 wherein the suspended coal of the providing has a particle size of less than about 100 microns, and at least a major portion of the suspended pyrite of the providing has a particle size of less than about 40 microns.

4. The method as in claim 2 wherein the aggregating includes flocculating said coal with a second polymeric agent, said second polymeric agent having a molecular weight of at least about 1,000,000.

5. The method as in claim 2 wherein said solids of the providing include shale.

6. The method as in claim 2 wherein said polymeric agent is a reaction product of polyacrylic acid and carbon disulfide and has a molecular weight of about 2,000 to about 20,000.

* * * * *